US007793919B2

(12) United States Patent
Guyard

(10) Patent No.: US 7,793,919 B2
(45) Date of Patent: Sep. 14, 2010

(54) HAND WINCH

(76) Inventor: Francois-Xavier Guyard, La thomassière, 41190 Chambon sur cisse (FR)

( * ) Notice: Subject to any disclaimer, the term of this patent is extended or adjusted under 35 U.S.C. 154(b) by 0 days.

(21) Appl. No.: 12/267,211

(22) Filed: Nov. 7, 2008

(65) Prior Publication Data

US 2009/0121204 A1 May 14, 2009

(30) Foreign Application Priority Data

Nov. 9, 2007 (EP) ..... 07021808

(51) Int. Cl.
*B66D 1/14* (2006.01)

(52) U.S. Cl. ..... 254/346; 254/345; 254/365; 254/383

(58) Field of Classification Search ..... 254/345, 254/346, 347, 350, 357, 365, 368, 383, 384
See application file for complete search history.

(56) References Cited

U.S. PATENT DOCUMENTS

| | | | | | |
|---|---|---|---|---|---|
| 1,482,924 | A | | 2/1924 | Hescock | |
| 1,795,058 | A | | 3/1931 | Townsend | |
| 2,546,202 | A | | 3/1951 | Trouin | |
| 2,649,281 | A | | 8/1953 | Hastings, Jr. | |
| 2,873,948 | A | * | 2/1959 | Colmer, Jr. et al. | 254/346 |
| 2,891,824 | A | * | 6/1959 | Fulton | 384/440 |
| 3,939,729 | A | * | 2/1976 | Brockelsby | 74/575 |
| 3,994,476 | A | | 11/1976 | van Gennep | |
| 4,003,550 | A | | 1/1977 | Brodin | |
| 4,004,780 | A | * | 1/1977 | Kuzarov | 254/345 |
| 4,106,754 | A | * | 8/1978 | Kucher | 254/352 |
| 4,456,227 | A | | 6/1984 | Notenboom | |
| 5,374,035 | A | * | 12/1994 | Santos | 254/339 |
| 5,573,091 | A | * | 11/1996 | Hung | 192/12 R |
| 6,116,580 | A | * | 9/2000 | Hull | 254/357 |
| 6,431,525 | B1 | * | 8/2002 | Roll | 254/357 |
| 7,140,598 | B2 | * | 11/2006 | Verakis et al. | 254/345 |
| 7,159,852 | B2 | * | 1/2007 | Dow et al. | 254/342 |
| 7,484,713 | B1 | * | 2/2009 | Young | 254/342 |
| 7,543,800 | B2 | * | 6/2009 | Grapes et al. | 254/376 |
| 7,556,241 | B2 | * | 7/2009 | Geagan | 254/342 |

FOREIGN PATENT DOCUMENTS

| | | |
|---|---|---|
| DE | 67707 | 8/1892 |
| DE | 880897 | 6/1953 |
| GB | 22229 | 3/1915 |
| GB | 197317 | 10/1923 |

* cited by examiner

*Primary Examiner*—Emmanuel M Marcelo
(74) *Attorney, Agent, or Firm*—Nils T. F. Schmid; R. Michael West

(57) ABSTRACT

Hand winch comprising a wind roll for receiving a flexible elongated member, an operation shaft engaged with the wind roll for transmitting forces therebetween, a friction brake including a gear member being in engagement with the wind roll and having a thrust position in which the gear member acts on a stationary member for generating braking forces directed oppositely to a sense of winding off the elongated member, characterized in that said gear member is movably mounted on the operation shaft such that, in case of winding off the elongated member, the gear member is displaced from a released position to said thrust position.

15 Claims, 5 Drawing Sheets

HAND WINCH

BACKGROUND OF THE INVENTION

1. Field of the Invention

The invention refers to a hand winch which comprises a wind roll for winding off and up a flexible elongated member, as a belt, a band, a cable or the like.

2. Description of the Prior Art

Usually, the hand winch comprises an operation shaft engaged with said wind roll for transmitting manual operation forces between the wind roll and the operation shaft. Further, hand winches can comprise a friction brake so that an operating person does not need to hold high load forces when letting down boats or other heavy items. A known friction brake can be activated by screwing a crank handle onto the operation shaft and thereby a gear member, being in a gear wheel connection with the winding roll, comes into a friction contact with a stationary member which may be rigidly connected to the operation shaft.

Such a hand winch suffers from the problem that the friction brake is to be deactivated by demounting the crank handle in order to unwind the elongated member in no load condition. Further, without the crank handle mounted, the brake system is not in an active operation mode. Therefore, the known hand winch implies security problems for operating persons. For instance, if accidentally the crank handle is demounted from the operation shaft, the friction brake is deactivated such that the load may wind off the elongated member "non-brakedly". Further, if the crank handle is only unfastened beyond the thread slightly so that a friction contact between the gear member and the stational member cannot be built up, so that no brake is active and the load accelerated without contact, the load applied to the elongated member still drives the wind roll which makes the operation shaft holding the loosened crank handle to turn which may injure the operation person.

It is an object of the invention to overcome the disadvantages of the prior art, particularly to provide a new hand winch which is improved with respect to more secure handling.

SUMMARY OF THE INVENTION

The hand winch according to the invention comprises a wind roll for receiving the flexible elongated member and the operation shaft being engaged with the wind roll for transmitting forces therebetween. Further, the hand winch comprises a friction brake which includes a gear member being engaged with the wind roll and having a thrust position in which the gear member acts on a stationary member for generating braking forces directed oppositely to the sense of winding off the elongated member. According to the invention, the gear member is movably mounted on the operation shaft such that in the case of winding off the elongated member, the gear member is displaced from a released position to the thrust position in no load condition. By the inventive technical measure of the invention, a completely internal friction brake is provided without having members being or even extending outside of the housing of the hand winch. In particular, no screwed connection of a crank handle is necessary in order to activate the friction brake. Rather, the friction brake self-activates automatically when a pulling load is applied to the elongated member. This measure improves the safety aspects of a hand winch in that the winch does not allow an uncontrolled rapid winding off of the elongated member, i.e. without the control of the friction brake. It also allows the use of a removable handle, and still have the friction brake operate as described above.

According to a preferred embodiment of the invention, the friction brake further includes a guiding device for displacing the gear member along the operation shaft from the released position to the shaft position. By realizing this structural measure, according to the invention it is clear that the gear member shall not be fixed to the operation shaft, rather is movably mounted onto the operation shaft. Preferably, the guiding device allows combined rotational and translatable movement of the gear member along the operation shaft towards the stationary member, in case of load on the elongated member.

In a preferred embodiment of the invention, the gear member is threaded on the operation shaft. A sense of rotation of the thread is determined in that, in the case of winding off the elongated member, the gear member is displaced towards the stationary member under load conditions.

In a further preferred embodiment of the invention, a gear member is biased by a thrust spring such that, in the case of winding up the elongated member, the gear member always remains in the thread engagement with the operation shaft. It is this technical measure of the gear member remaining in a threaded engagement which provides the automatic self-activation of the friction brake. As soon as a pulling load is applied to the wind roll and the wind roll starts to rotate, because of said thrust spring, the gear member turns and, due to the thread engagement with the operation shaft, the gear member is displaced towards the stationary member to generate friction forces to brake down the pulling movement caused by the load.

A further independent aspect of the invention is described in the following which, however, can be combined with the above-mentioned aspects of the invention.

The invention also refers to a hand winch comprising a wind roll for receiving a flexible elongated member, as a belt, a band, a cable or the like, and a friction brake defining an active braking status or a passive release status. According to the invention, an activating mechanism installed within the hand winch, activates the friction brake automatically, when load or pulling forces are applied to the elongated member.

In a preferred embodiment of the invention, the actuating mechanism comprises a movable operation part or handle which may be a movably supported housing part of the hand winch. The operation part can manually be operated, particularly in order to deactivate the friction brake. The movable operation handle can be a pivoting housing part which is rotatably supported to a stationary housing basis. The operation handle comprises a guideway, particularly an opening, for the elongated member to extend therethrough. When load or pulling forces are applied to the elongated member, and consequently the elongated member is stretched, the operating handle is moved to an activating positing as its guideway follows the course of the stretched elongated member automatically.

Preferably, the activating mechanism includes a stationary member as a brake disc. The stationary member can be rotatably mounted on the operation shaft and is optionally lockable at least in one turning sense around the operation shaft. This stationary member cooperates with the gear member, as a pinion, above-mentioned of friction brake. The gear member being rotatably supported on the operation shaft, too. This stationary member comprises a passive operation mode in which the stationary member can freely move together with the gear member. Further, the stationary member comprises an active operation mode in which the stationary member is fixed such that friction forces are generated between the stationary member and the gear member.

In a further preferred embodiment of the invention, the actuating mechanism comprises a ratchet, as a latch, for the member rotatably mounted on the operation shaft supporting also the stationary gear member in that, in case of a load to the elongated moves the movable operation member which acts on the ratchet for blocking the stationary member so that it cannot turn together with the gear member at least in one turning sense. If the load is released, the movable operation part turns back by forces or manually so that the latch is released from the stationary member that they can freely rotate with the gear member.

In a preferred embodiment, the ratchet is biased by a spring such that the ratchet is brought into a blocking engagement within a stationary member. Further, the operation handle can manually be operated or moved and then acts on the ratchet in a passive position such that the stationary member is released from the ratchet.

Preferably, the stationary member is made of bronze. Alternatively, between the gear member and the stationary member, a ring of bronze can be positioned.

Further features, advantages and characteristics of the invention will be described in view of the following description of a preferred embodiment by means of the enclosed drawings.

DETAILED DESCRIPTION OF THE PREFERRED EMBODIMENT

Figure 5:
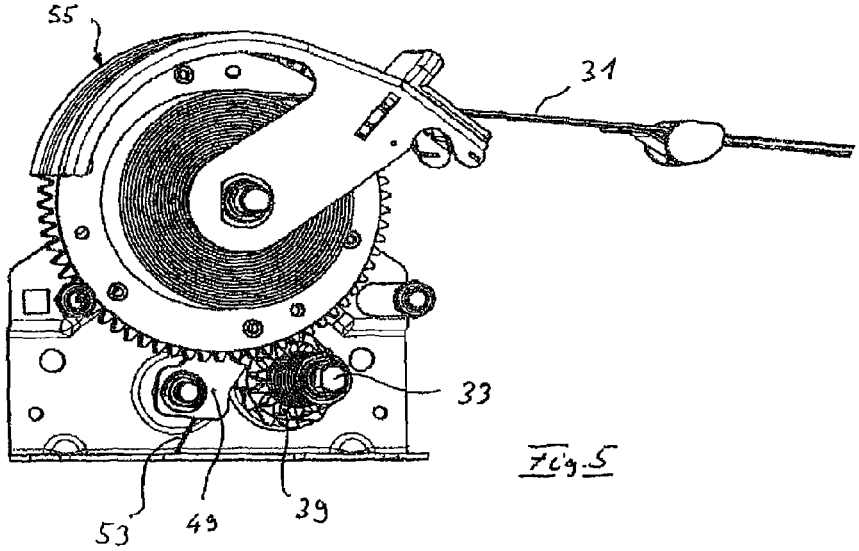
FIG. 5 is a perspective view of the hand winch according to FIG. 2, the friction brake being activated as the pulling belt is loaded and stretched.
Figure 6:
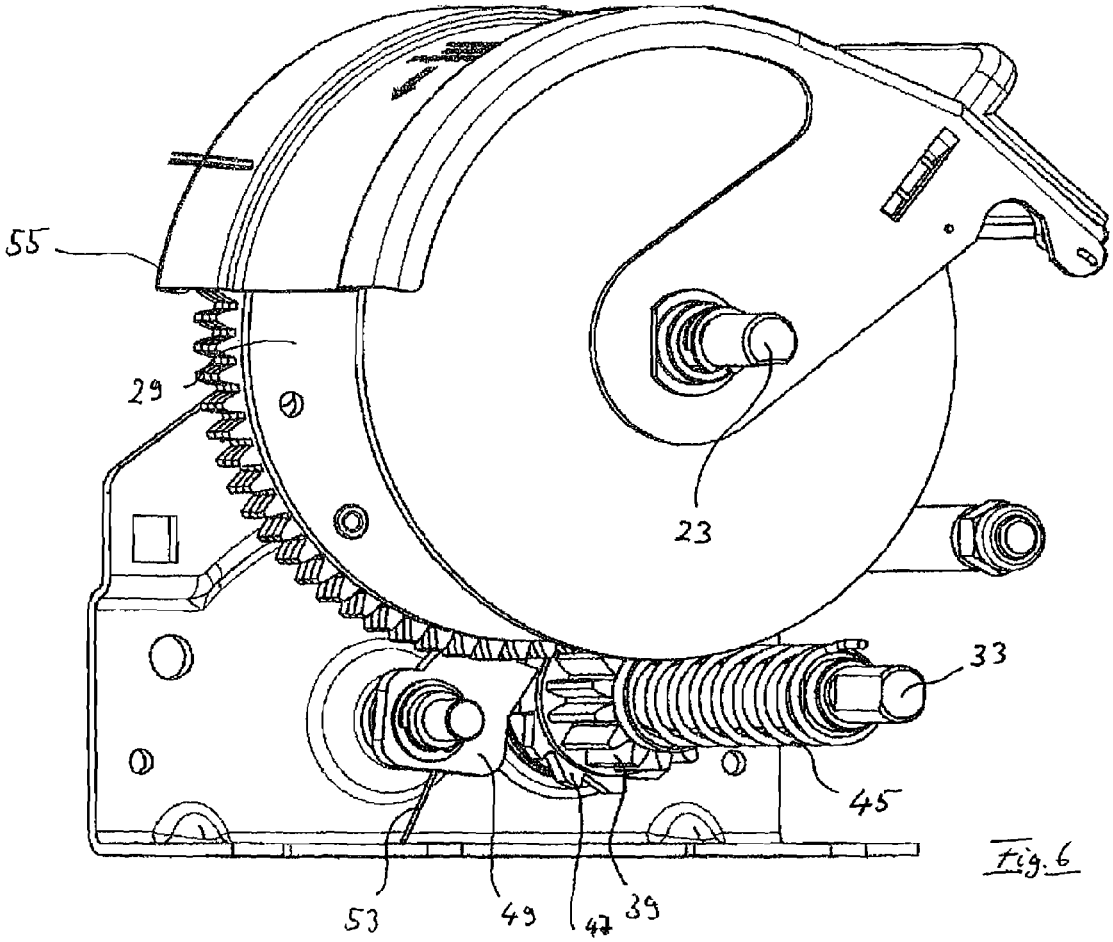
FIG. 6 is an enlarged perspective view according to FIG. 5 without the pulling belt; and, FIG. 7 is a perspective detailed view according to FIG. 6 the winding roll being removed for better visibility.
Figure 7:
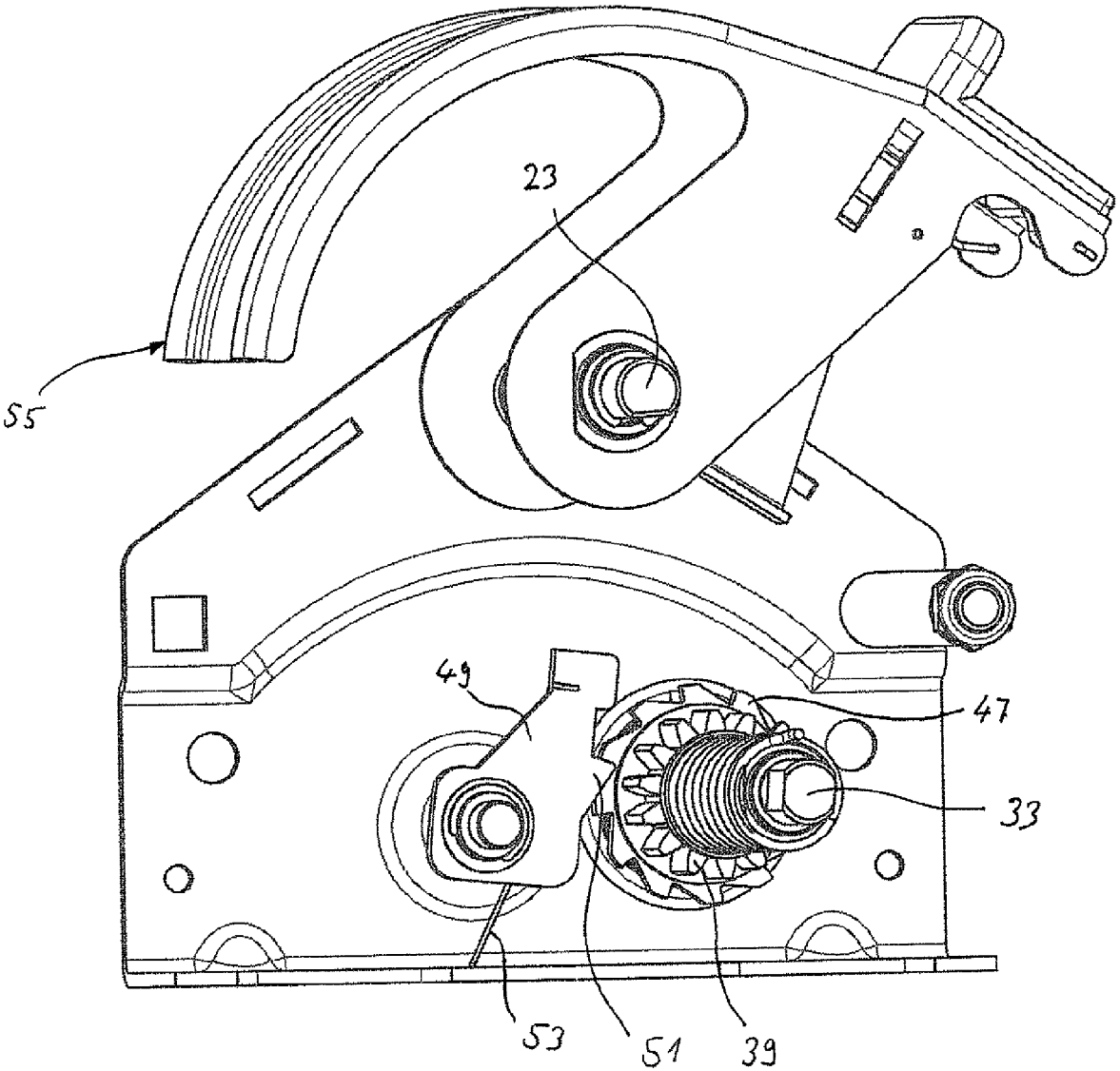

In FIGS. 1 to 7, the hand winch according to a preferred embodiment of the invention is generally denoted with the reference sign 1. While in FIGS. 2, 3 and 4, the hand winch 1 is mounted in an operation mode, in which no load forces are applied to the hand winch and the belt loosely drops, FIGS. 5, 6 and 7 show a loaded hand winch in which a friction brake is automatically activated, i.e. as soon as a load, as a boat or the like, is applied to the pulling belt 31.

In the following, the main elements of the hand winch 1 according to the preferred embodiment of the invention are introduced.

Figure 1:
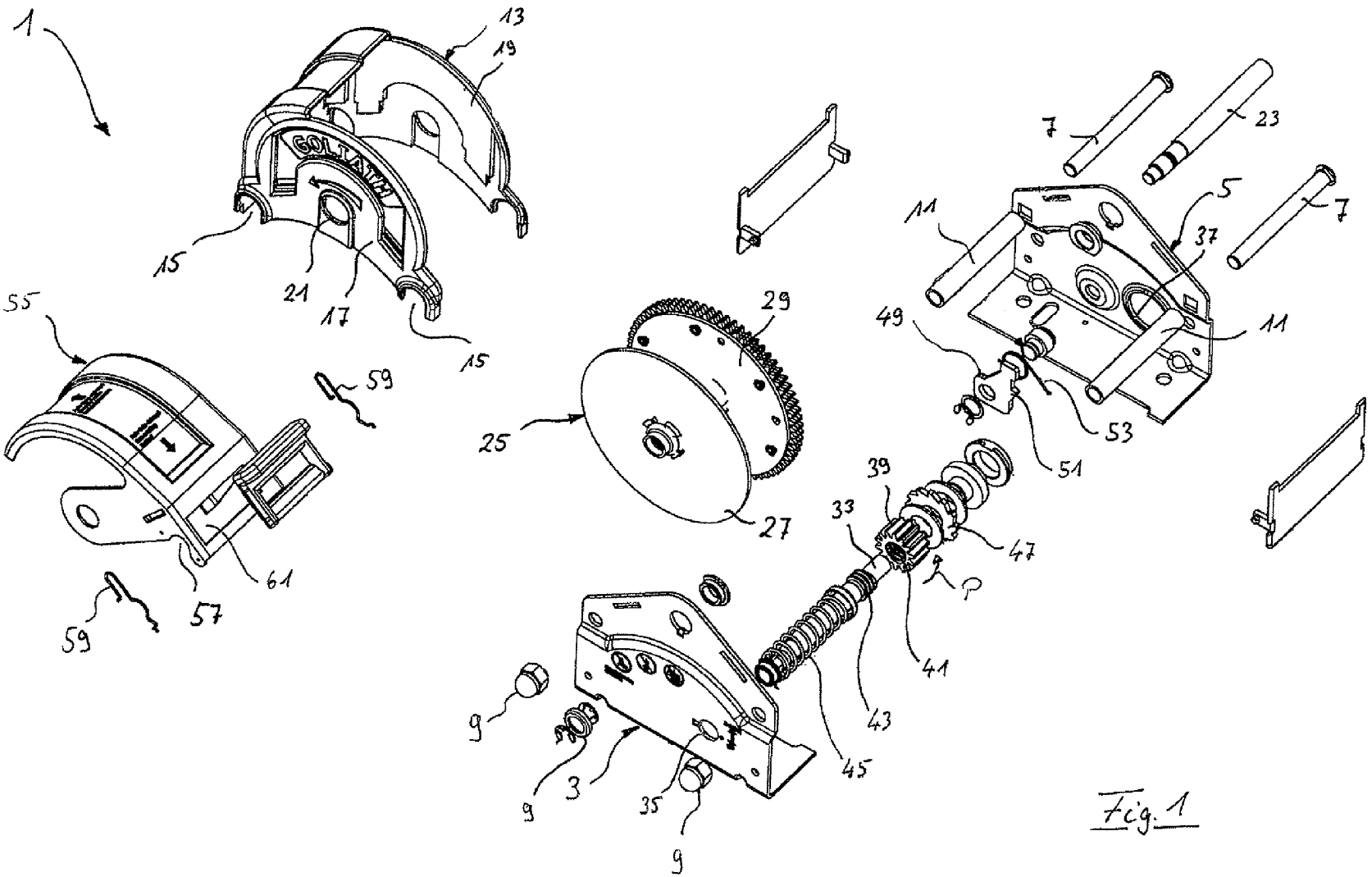
FIG. 1 shows a perspective explosion view of elements of a hand winch according to the invention.
Figure 3:
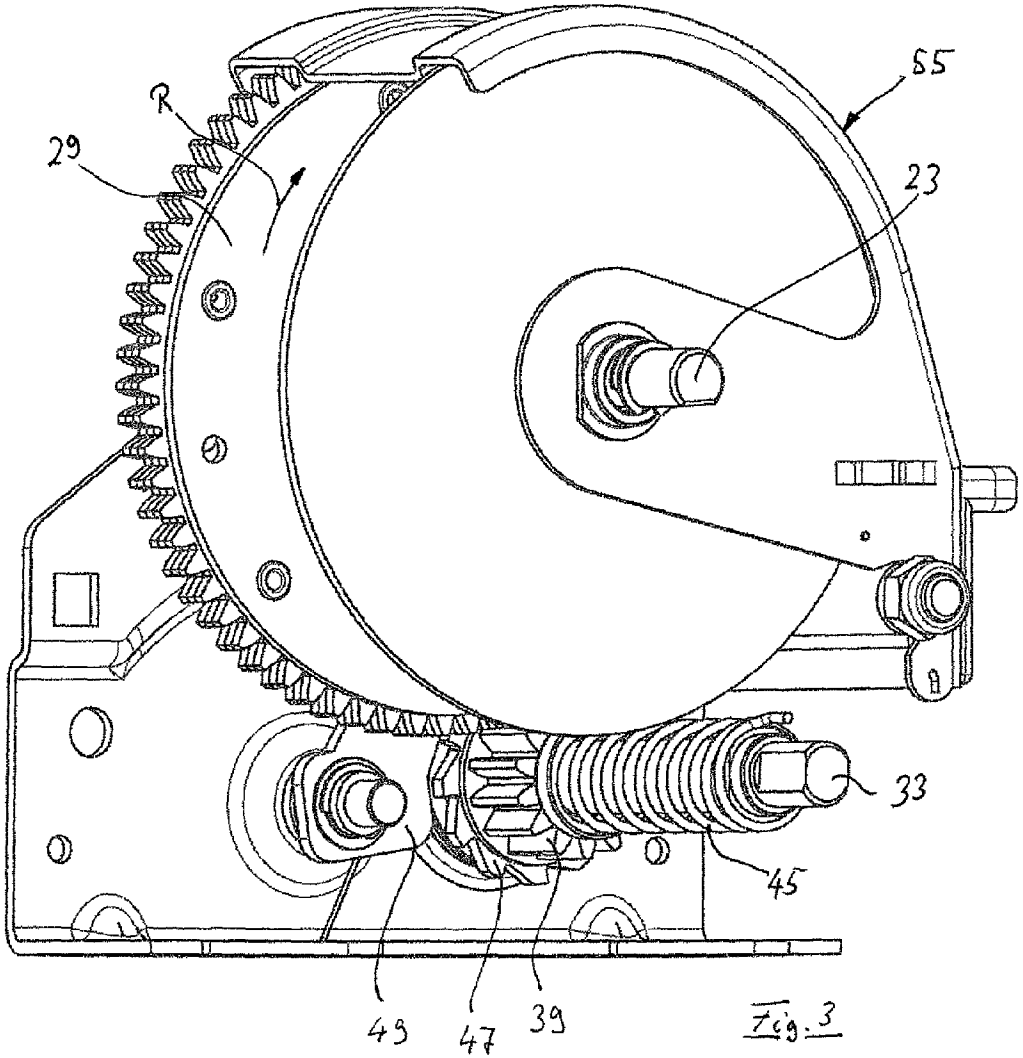
FIG. 3 is an enlarged perspective view according to FIG. 2 without a pulling belt.
Figure 2:
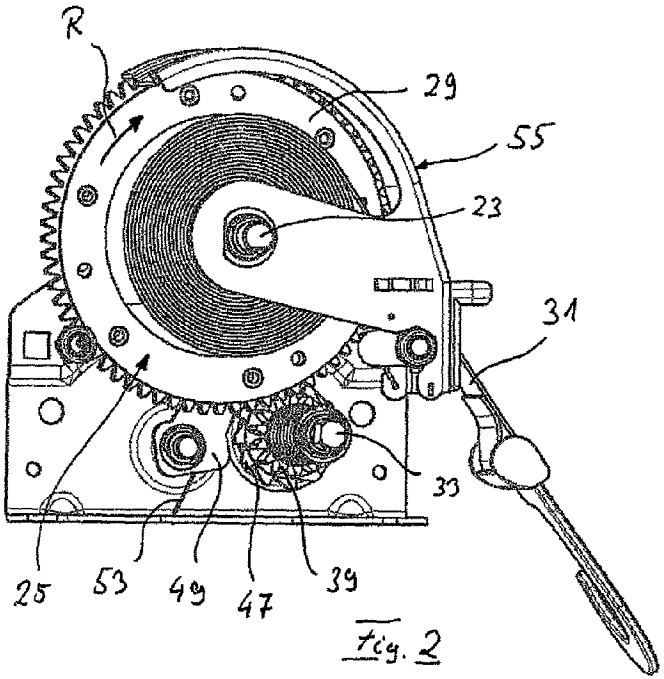
FIG. 2. shows a perspective view of the mounted hand winch according to FIG. 1, a friction brake being deactivated and a part of the housing being removed for better visibility of the interior of the hand winch.
Figure 4:
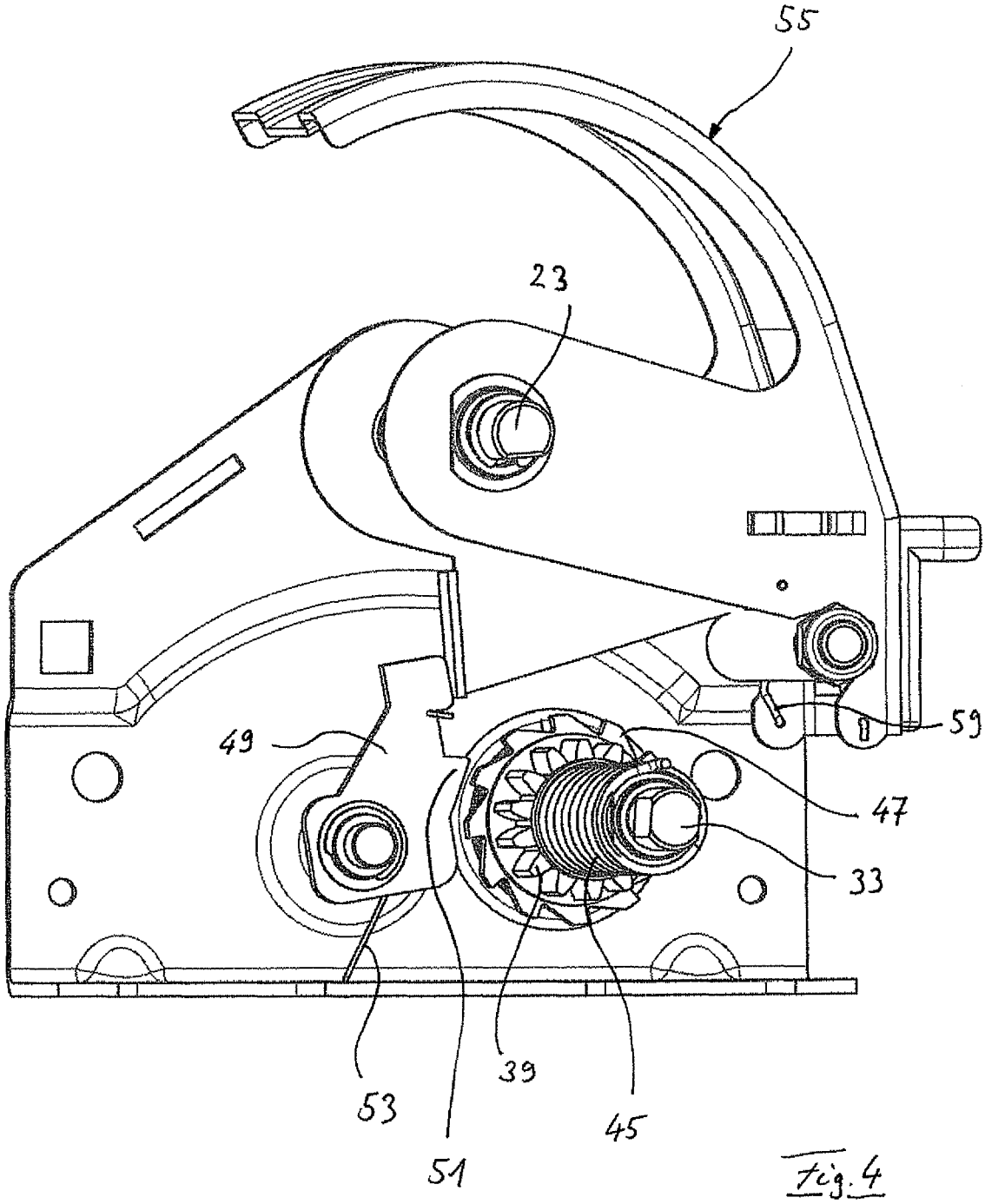
FIG. 4 is a perspective view of the hand winch according to the FIGS. 2 and 3, a winding roll has been removed for better visibility of a ratchet of a friction brake activating mechanism.

According to FIG. 1, the hand winch 1 comprises a housing constituted as a basis by two L-formed side-walls 3, 5 which can be secured to each other via two bolts 7 and respective screws 9.

The bolts 7 receive sleeves 11 which extend internally and transversally from the one side wall 3 to the other side wall 5. The sleeves 11 are designed to receive a stationary top part of housing 13 having two pairs of circular recesses 15 in which the sleeves 11 are received when the top part housing 13 is mounted onto the side walls 3, 5. The top part housing 13 consists of two side wing walls 17, 19, in which holes 21 are formed for supporting a primary axle 23 carrying a wind roll 25.

The wind roll 25 consists of two axial outer plates 27 (29) concentrically mounted on the primary axle 23, one of which is formed as a dented gear wheel (29) having a large diameter. In between the gearwheel 29 and the plate 27, an elongated element as a pulling belt 31 is wound. By turning clockwise, as indicated by arrow R, the belt 31 can be wound off from the wind roll 25. In opposite rotation sense, the belt 31 is wound up to the wind roll 25.

The two L-formed walls 3, 5 of the housing support the primary axle 23 and a secondary axle by means of passages 35, 37 formed therein. The larger passage 37 is formed in the L-formed side wall adjacent to the dented gear wheel 29.

A gear member, namely a pinion 39, mounted onto the secondary axle 33 can freely rotate on the axle 33 and comprises an internal thread 41 cooperating with an external thread 43 formed on the secondary axle 33. The external thread is formed only partly along the secondary axle 33.

In a mounted position, on its circumference, the pinion 39 is in a meshed engagement with the dented gear wheel 29, and on its inside, the pinion is threaded onto the secondary axle 33. A thrust spring 45 rests on the inside of the L-formed side wall 3 and on one side of the pinion 39 such that the pinion 39 is ever pushed towards the L-formed side wall 5 adjacent to the pinion 39. The threads of the pinion 39 and the axle 33 are designed such that, in case of a anti-clockwise rotation as indicated in FIG. 1 by arrow P, the pinion 39 moves translationally along the axle 33 towards the L-formed side-wall housing 5 in order to come in a frictional engagement with an optionally stationary element of a completely internal friction brake.

Said friction brake comprises an optionally stationary element a brake disc 47 mounted onto the secondary axle 33, in specific operation mode of the friction brake. The brake disc 47 can freely rotate about the secondary axle 33. The brake disc 47 comprises on its circular circumference a continuous row of teeth in order to provide a ratchet function.

Said brake disc 47 cooperates with a latch 49 which is spring biased such that a protrusion 51 of the latch 49 comes into a meshed engagement between two adjacent teeth of the brake disk 47. Thereby, the brake disk 47 is set stationarily. A rotation spring 53 is provided in order to push the latch 49 towards the brake disc 47.

On the top of the top part housing 13 a pivoting handle 55 is rotatably mounted on the primary axle 23. The pivoting handle 55 comprises two semi-circular cut-offs 57 which are engaged by the sleeves 11 when the pivoting handle 55 is brought into a deactivating position in which the self-activating friction brake is deactivated.

In order to hold the pivoting handle 55 in this position, two grasping springs 59 are fixed to the pivoting handle 55 for releasingly grasping the respective sleeves 11 in the said deactivating position.

Internal friction brake is activated automatically when load is applied to the wind roll.

All members of the friction brake for generating friction forces are positioned within the housing of the hand winch 1. The internal friction brake consists of the pinion 39, the brake disc 47 and the latch 49 and can be automatically activated when a load is applied to the belt 31.

In the case of application of pulling load to the belt 31, the wind roll 25 including the dented gear wheel 29 intends to rotate in a clockwise sense R. Because of the meshed engagement between the pinion 39 and the gear wheel 29 and because of the thrust spring 45 urging the pinion 39 towards the brake disc 47, the pinion 39 remains in the threaded engagement with the secondary axle 33, such that by a minor rotation of the gear wheel 29 and due to the large transmission ratio between the pinion 39 and the gear wheel 29, the pinion 39 is rotated counter-clockwise and therefore moved translationally along the axle 33 towards the brake disc 47. As can be seen in FIG. 7, as the latch 49 is in the meshed engagement with the brake disc 47, so that the latch 49 cannot rotate counter-clockwise and therefore is blocked.

In this operation mode, the pinion 39 comes into a frictional engagement with the brake disc 47 and friction forces are generated between the brake disc 47 and the pinion 39 which are transferred into the gear wheel 29 obstructing a rotational moving of the gear wheel 29 and therefore stopping the movement of the load applied to the belt 31. In this state, the belt 31 cannot be wound off the wind roll 25 by the load forces only.

However, in order to let down the load applied to the belt 31, a crank handle (not shown) can be plugged from the outside of the housing of the hand winch 1 onto the secondary axle 33. By turning the crank handle the unit engaged of the pinion 39 and the axle 33 can be pivoted by overcoming the friction forces between the pinion 39 and the brake disc 47, while the brake disc 47, blocked by the latch 49, remains stationary (FIGS. 5, 6, 7).

Preferably, the brake disc 47 is made of bronze, or a ring of bronze is positioned between the brake disc 47 and the pinion 39.

In the case that the crank handle is unintendedly released from the subsidiary secondary axle 33, the pinion 39 remains in the friction contact with the brake disc 47 which keeps stopping a further winding off the belt 31 and therefore a movement of the load.

Deactivation of the friction brake. In the case no load is provided to the belt 31, usually the belt 31 is in a position as in FIG. 2. The pivoting handle 55 can manually be brought into a releasing position in which the handle 55 releases the spring-biased latch 49 from the brake disc 47 such that the brake disc 47 can freely rotate together with the pinion 39 around the secondary axle 33. No friction forces are generated between the brake disk 47 and the pinion 39. Consequently, the belt 31 can easily be wound off the wind roll 25 by manually pulling it.

Additionally, if the belt 31 is completely wound off, in the releasing position of the pivoting handle 55, a crank handle can be mounted to the primary axle 23 in order to drive the wind roll 25 for winding up the belt with high speed. It is to be considered that a connection between the crank handle and the primary axle 23 is designed such that the crank handle can drive the axle 23 only in one rotation sense for winding up the belt 31.

In the case, a load 31 is applied to the belt 31, as seen in FIG. 5, the belt 31 is stretched and usually takes on specific more horizontal course. As the belt 31 extends through a passage way 61 formed in the pivoting handle 55, the movable pivoting handle 55 automatically follows the course of the rigidly stretched belt 31 and pivots into an upswing activating position, as visible in FIGS. 5, 6 and 7. As seen in FIG. 7, the pivoting handle 55 releases the latch 49, so that the rotating spring 53 pushes the latch 49 towards the teeth of the brake disc 47 which comes into a meshed engagement with the protrusion 51 of the latch 49. As described above, in this operation mode friction forces are generated between the brake disc 47 and the pinion 39 which has moved towards the brake disc 47 because of its thread engagement with the axle 33 and the drive of the gear wheel 29.

It is understood that the features of the invention as disclosed in the above description, in the drawings, and with claims may be essential to achieve the invention, both by themselves or in any combination with each other.

What is claimed is:

1. A hand winch comprising: a wind roll for receiving a flexible elongated member, an operation shaft engaged with said wind roll for transmitting forces therebetween, a friction brake including a gear member in engagement with said wind roll and having a thrust position in which said gear member acts on a stationary member for generating braking forces directed oppositely to a sense of winding off said elongated member, and in which said gear member is threadably mounted on said operation shaft and biased by a thrust spring such that, in case of winding off said elongated member, said gear member is displaced from a released position to said thrust position, and in the case of winding up said elongated member, said gear member remains in threaded engagement with said operation shaft.

2. A hand winch as in claim 1 in which said friction brake further includes guiding means for displacing said gear member along said operation shaft from said released position to said thrust position.

3. A hand winch as in claim 2 in which said guiding means allows a combined rotational and translational movement of said gear member.

4. A hand winch as in any of the preceding claims in which a sense of rotation of the thread for said gear member is such that, in the case of winding off said elongated member, said gear member is displaced toward said stationary member.

5. A hand winch comprising: a wind roll for receiving a flexible elongated member, a friction brake defining an active braking status and a passive release status, in which an activating mechanism activates the friction brake when load forces are applied to said elongated member, wherein said activating mechanism comprises a moveable operation handle having a passageway for said elongated member such that, when load forces are applied to said elongated member and consequently the elongated member is stretched, said operation handle is moved to an activating position as the passageway follows the course of the stretched elongated member.

6. A hand winch as in claim 5, in which said activating mechanism further includes a stationary member cooperating with a gear member of said friction brake, said stationary member having a passive condition, in which the stationary member can freely move with said gear member, and an active condition in which said stationary member is fixed such that friction forces are generated between said stationary member and said gear member.

7. A hand winch as in claim 6, in which said activating mechanism comprises a ratchet for fixing said stationary member rotatably mounted on an operation shaft supporting the gear member such that, in the case of winding off the elongated member, said stationary member is engaged by said ratchet and prevented from rotating with said gear member.

8. A hand winch as in claim 7, in which said operation handle acts on the ratchet in a passive position such that the stationary member is released from said ratchet.

9. A hand winch as in claim 1 or 6 in which said flexible elongated member comprises a belt, a band, or a cable.

10. A hand winch comprising: a wind roll for receiving a flexible elongated member, a friction brake defining an active braking status and a passive release status, in which an activating mechanism activates said friction brake when load forces are applied to said elongated member, in which said activating mechanism further includes a stationary member cooperating with a gear member of said friction brake, said stationary member having a passive condition, in which said stationary member can freely move with said gear member, and an active condition in which said stationary member is fixed such that friction forces are generated between said stationary member and said gear member, in which said activating mechanism comprises a ratchet for fixing said stationary member rotatably mounted on an operation shaft supporting the gear member such that, in the case of winding off the elongated member, said stationary member is engaged by said ratchet and preventing from rotating with said gear member.

11. A hand winch comprising: a wind roll for receiving a cable, an operation shaft engaged with said wind roll for transmitting forces therebetween, a friction brake including a gear member in engagement with said wind roll and movably mounted on said operation shaft, said gear member having a released position allowing rotation of said wind roll for winding up said cable, and having a thrust position in which said gear member acts on a stationary member for generating braking forces resisting letting out of said cable.

12. A hand winch as in claim 11 in which said friction brake further includes guiding means for displacing said gear member along said operation shaft from said released position to said thrust position.

13. A hand winch as in claim 12 in which said guiding means allows a combined rotational and translational movement of said gear member.

14. A hand winch as in claim 11 in which said gear member has threads which are threadably engaged with threads on said operation shaft, and in which the handedness of said gear member threads is such that when said wind roll is rotated in a direction to let out said cable, said gear member is displaced toward said stationary member.

15. A hand winch as in claim 14 in which said gear member is biased by a thrust spring such that when said wind roll is rotated to wind up said cable, said gear member remains in threaded engagement with said operation shaft.

* * * * *